United States Patent [19]

Petrov et al.

[11] 4,234,625

[45] Nov. 18, 1980

[54] PROCESS FOR PRODUCING MATERIAL SENSITIVE TO ELECTROMAGNETIC AND CORPUSCULAR RADIATION

[76] Inventors: Vyacheslav V. Petrov, prospekt Vernadskogo, 85, kv. 55; Andrei A. Krjuchin, ulitsa Studencheskaya, 12/14, kv. 43, both of Kiev, U.S.S.R.

[21] Appl. No.: 870,835

[22] Filed: Jan. 19, 1978

[51] Int. Cl.[2] ..... G03C 5/00

[52] U.S. Cl. ..... 427/74; 427/76; 427/87; 427/108; 427/6; 430/297; 430/299; 430/323; 430/495; 430/524; 427/376.1; 427/376.6; 427/383.9

[58] Field of Search ..... 427/76, 74, 87, 108, 427/376 R, 376 E, 376 G, 383 D; 136/89 CC; 430/495, 524, 297, 299, 323

[56] References Cited

U.S. PATENT DOCUMENTS

| | | | |
|---|---|---|---|
| 3,239,376 | 3/1966 | Schmidt | 427/91 |
| 3,253,951 | 5/1966 | Marinaccio et al. | 427/91 |
| 3,637,377 | 1/1972 | Hallman et al. . | |
| 3,637,381 | 1/1972 | Hallman et al. . | |

FOREIGN PATENT DOCUMENTS 49-81036 of 1974 Japan .

*Primary Examiner*—John D. Smith

*Attorney, Agent, or Firm*—Lackenbach, Lilling & Siegel

[57] ABSTRACT

A process of producing a material sensitive to an electromagnetic and corpuscular radiation involves successively depositing, onto a transparent substrate, a layer of a semiconductor, a barrier layer inert to the semiconductor layer and a layer of a metal capable of reacting with the semiconductor layer under the effect of the electromagnetic and corpuscular radiation with the formation of the reaction products. After deposition of the metal layer, there is performed annealing at a temperature equal to or exceeding the temperature of diffusion of the material of the barrier layer into the material of the layers adjacent thereto. The annealing is conducted for a period sufficient for a partial or a complete dissolution of the barrier layer.

4 Claims, 4 Drawing Figures

PROCESS FOR PRODUCING MATERIAL SENSITIVE TO ELECTROMAGNETIC AND CORPUSCULAR RADIATION

The present invention relates to processes for the production of materials sensitive to an external effect and, more specifically, to processes for producing materials sensitive to an electromagnetic and corpuscular irradiation (actinic irradiation). Such materials are employed for the manufacture of information carriers for optical memory devices, video-recording devices and other recording instruments.

Known in the art is a process for producing a material sensitive to a corpuscular or electromagnetic irradiation consisting in the following steps: application, onto a substrate, of a metal layer, deposition of a semi-conductive substance on the metal layer; said semiconductive substance being capable of interaction, under the influence of an actinic irradiation, with the metal layer to form the interaction products having physical and chemical properties different from physical and chemical properties of the metals layer and the layer of said semi-conducting substance.

The material produced by this process has a high contrast value within the range of from 10 to 20 (ratio of the reflection coefficient of a non-irradiated material to the reflection coefficient of the irradiated material) though only upon exposure from the semi-conductive layer side.

However, in this material the semiconductive layer is non-protected from the influence of external mechanical effects (contamination with dust particles, scratches) which results in distortion of the information recorded on the material.

It is known that the effective protection of a material sensitive to an electromagnetic and corpuscular irradiation as well as of the information recorded thereon may be ensured by recording and reading-out the information through a transparent medium with a thickness substantially greater than a depth of focus of a system of the image formation. A transparent substrate can serve as such medium. In the above-described process for producing a material sensitive to a electromagnetic and corpuscular irradiation, a metal layer is deposited, from the substrate side. The changed sequence of application of semi-conductive and metallic layers causes certain difficulties which are due to the fact that upon spraying, onto the semi-conductive layer, of a metal layer there is observed a substantial increase in the effective temperature of the semi-conductive layer resulting in diffusion of a metal into the semi-conductive layer during the material manufacture. This imposes certain restrictions on the range of semi-conductive compounds and metals employed to those having the heat of formation of new compounds exceeding the amount of heat evolved during the material manufacture.

Semi-conductive compounds and alloys of the type As-S, As-Se, As-S-Se, SB-S, Sb-S-Se, enabling the production of a material with a high sensitivity cannot be practically employed in the above-described process.

Also known in the art is a process for producing a material sensitive to an electromagnetic and corpuscular irradiation comprising deposition, onto a transparent substrate, of a layer of a semi-conductive material, spraying of a barrier layer onto the semi-conductive material layer which barrier is inert in respect of the semi-conductor layer and deposition, onto said barrier layer, of a layer of a metal capable of chemically reacting, under the influence of electromagnetic or corpuscular irradiation, with the layer of semiconductor with the formation of the reaction products having chemical and physical properties differing from those of the metal layer and semiconductor layer (cf. U.S. patent application Ser. No. 651139 of Jan. 21, 1976).

This process enables the manufacture of materials sensitive to electromagnetic and corpuscular irradiation, wherein as a material for the semiconductor layer use can be made of a broad range of semiconductive substances. However, these materials possess a lowered sensitivity due to the presence of a barrier layer between the layers of a semiconductive substance and metal.

It is the principal object of the present invention to provide a process for producing a material sensitive to an electromagnetic and corpuscular irradiation which ensures that the material thus prepared simultaneously possesses a high contrast value and a high sensitivity.

It is another object of the present invention to provide a process which makes it possible to employ a wide range of semiconductive compounds for the manufacture of a material sensitive to an electromagnetic and corpuscular irradiation.

Still another object of the present invention is to provide a process enabling preparation of a material with an exposure characteristic of a predetermined shape.

These objects are accomplished by a process for the production of a material sensitive to an electromagnetic and corpuscular irradiation which comprises the steps of deposition, onto a transparent substrate, of a layer of a semiconductive material followed by deposition of a barrier layer which is inert with respect to the semiconductive layer onto the latter; spraying, onto said barrier layer, of a layer of a metal capable of chemically reacting with the semiconductive layer under the influence of said electromagnetic and corpuscular irradiation with the formation of the reaction products which have physical and chemical properties different from those of the metal layer and semiconductive layer. In accordance with the present invention, after deposition of a metal layer, annealing is conducted at a temperature equal to or exceeding the temperature of diffusion of the material of the barrier layer into the material of at least one of the adjacent layers for a period sufficient for a partial or complete dissolution of the barrier layer.

To produce a material with the maximum sensitivity, it is advisable to perform the annealing to the complete dissolution of the barrier layer.

In certain cases, to obtain the desired shape of the exposure characteristic and sensitivity, it is advisable to perform the annealing to a partial dissolution of the barrier layer.

It is also advisable, to retain the unchanged band of the spectral sensitivity of the material, to perform dissolution of the barrier layer only in the metal layer. In this case, prior to the deposition of a barrier layer, a protecting film is applied onto the semiconductive layer which film acts as an anti-diffusion barrier between said layers.

To stabilize the performances of the semiconductive layer (produce a more uniform structure of the semiconductive layer) in the case where it is produced from such materials as As-S, As-Se, Sb-S, Sb-Se, S-Se, As-S-Se, it is possible to perform annealing of the material at a temperature equal to 0.7–0.9 of the vitrification temperature of the semiconductive layer substance.

The process for the manufacture of a material sensitive to an electromagnetic and corpuscular irradiation according to the present invention makes it possible to obtain materials ensuring protection of the recorded information from the influence of external mechanical effects by a transparent substrate and possessing a high sensitivity.

The present invention is further illustrated by the description of its embodiments and the accompanying drawings, wherein.

Figure 1:
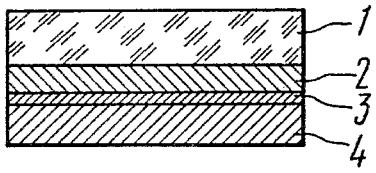
FIG. 1 is a cross-sectional view, in elevation, showing a material sensitive to an electromagnetic or corpuscular irradiation in the manufacture stage prior to the annealing operation.

The process of producing a material sensitive to an electromagnetic and corpuscular irradiation according to the present invention consists in the following. Onto a transparent substrate 1 (FIG. 1) constituted for example by transparent dielectrics such as glass, quartz and the like and organic transparent plates, there are deposited in succession by vacuum evaporation a layer 2 of a semiconductive material, a barrier layer 3 and a layer 4 of a metal capable of chemically reacting with the semiconductor layer under the influence of an electromagnetic and corpuscular irradiation. The substrate 1 thickness exceeds the focus depth of the system of image formation on the material and ranges from 1 to 10 mm.

As a metal layer 4 use can be made of such metals as Ag, Cu, Tl possessing low temperatures of formation of compounds upon chemical reaction with sulphides, selenides and tellurides of arsenic, antimony and bismuth under the effect of an electromagnetic and corpuscular irradiation. Thickness of the metal layer 4 is selected within the range of from 400 to 10,000 Å.

As the layer 2 of the semiconductive compound use can be made of compounds and alloys such as As-S, As-Se, As-As-S-Se, Sb-S, Sb-Se, Sb-S-Se, which have low heat values of formation of new compounds upon reaction with silver, copper and thallium under the effect of an electromagnetic and corpuscular irradiation thus ensuring the production of highly sensitive materials.

It is most advisable to employ, as the semiconductive substance, alloys and compounds which make it possible to produce, upon reaction with the metal layer, compounds of the stoichiometric or substantially stoichiometric composition in a vitreous state such as $AsS_2$, $AsSe_2$, $SbS_2$, $SbSe_2$, $AsS_{2-x}$, $Se_x$, wherein $0<x<2$ and the like. The thickness of the semiconductive compound layer 2 is selected within the range of from 100 to 5,000 Å.

As the material for the barrier layer 3 use can be made of different metals and alloys thereof such as Mo, Au, Cr, Pt, Fe, Pb, Ni, Cd, Al, Mn, Zn, Mg, As, Bi, Ga, In, Sb, Sn, Co, excluding Ag, Cu, Tl; elemental semiconductors such as Si, Ge and dielectrics such as C, B as well as sulphides, tellurides, and selenides of these metals. It is advisable, however, to select metals as the material for the barrier layer 3, since the barrier layer 3 embodied of metals protects, at a smaller thickness as compared to a barrier layer 3 made of sulphides, tellurides and selenides of said metals, the semiconductor layer 2 from the reaction with the metal (Ag, Cu, Tl) of the layer 4 upon application of the latter during the material manufacture and can be easily dissolved in at least one of the adjacent layers 2 and 4 at a lower temperature. The barrier layer thickness is selected to be sufficient to prevent chemical reaction between the layer 2 of the semiconductor and layer 4 of the metal during the material manufacture at the exposure to an electromagnetic irradiation of a low intensity and elevation of an effective temperature of the layer 2 of the semiconductor. An optimal thickness of the barrier layer 3 is selected within the range of from 20 to 200 Å.

As the material for the barrier layer 3 it is desirable to use alloys possessing a fine crystalline structure, onto which a layer 4 of a metal is deposited epitaxially. In this case there is obtained a material which is sensitive to an electromagnetic and corpuscular irradiation and has a maximum resolving power owing to the fact that the metal layer is condensed in the fine-crystal phase.

To deposit the layers, use can be made of different methods of vacuum application of thin films, i.e. thermal evaporation, electron-ray scattering, cathodic deposition and like methods which ensure a high purity of the films produced along with uniformity of thickness and a good reproducibility of the results.

After deposition of a metal layer 4 onto the barrier layer 3 there is performed annealing of the material in order to dissolve the barrier layer 3 in the layer 2 or in the layer 4 or in both said layers simultaneously. The annealing time is selected to be sufficient for complete or partial dissolution of the barrier layer 3.

Figure 2:
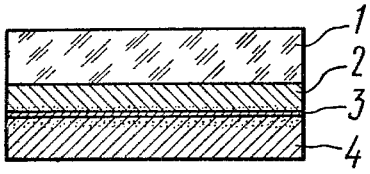
FIG. 2 is a cross-sectional view, in elevation, showing a material sensitive to an electromagnetic and corpuscular irradiation after annealing to a partial dissolution of the barrier layer, elevation view.

In the case of partial dissolution (shown in FIG. 2) the presence of a portion of the barrier layer 3 in the material makes it impossible to obtain maximum sensitivity for a given pair of a semiconductive substance and a metal; however, it ensures a more linear exposure characteristic of the material sensitive to an electromagnetic and corpuscular irradiation.

To obtain a material with maximum sensitivity, annealing is performed until complete dissolution of the barrier layer 3.

Figure 3:
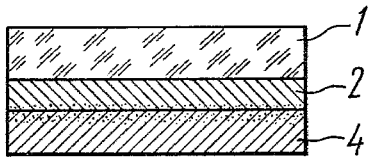
FIG. 3 is a cross-sectional view, in elevation, showing a material sensitive to an electromagnetic and corpuscular irradiation after annealing to a complete dissolution of the barrier layer.

Shown in FIG. 3 is a cross-sectional view of a material sensitive to electromagnetic and corpuscular irradiation after annealing is conducted until complete dissolution of the barrier layer. Further annealing results in no increase in material sensitivity.

To dissolve a barrier layer which is made of gold, germanium, lead, tin, gallium the annealing temperature should exceed 60° C. To dissolve a barrier layer 3 which is made of chromium, molybdenum, nickel, iron the annealing temperature should be at least equal to 100° C.

An mandatory precondition of annealing of the material sensitive to an electromagnetic or corpuscular irradiation resides in protection of its free surface with a varnish coating which prevents it from partial oxidation in the structure when using films of a very small thickness (within the range of from 200 to 1,000 Å).

In the case where the material for the semiconductive layer is made of As-S or As-Se, Sb-S, Sb-Se, As-S-Se, Sb-S-Se, the annealing temperature can be higher than the temperature of diffusion of the barrier layer 3 and it should be equal to 0.7–0.9 of the vitrification temperature of the semiconductive layer substance 2. For this group of substances the annealing temperature should be selected, with due account of the above-mentioned considerations, within the range of from 100° to 180° C.

Annealing at the above-indicated temperatures results in the formation of a more uniform film of the semiconductor which contributes to the production of a material with a permanent sensitivity over the material surface and a narrowed band of spectral sensitivity.

To protect the layer 2 of the semiconductor from penetration thereinto of atoms of the metal of the barrier layer 3 during the annealing, an antidiffusion protective layer is applied onto the semiconductor layer 2 prior to the deposition on the latter of the barrier layer 3. On said protective layer there are deposited successively the barrier layer 3 and the layer 4 of the metal and thereafter annealing is performed.

Figure 4:
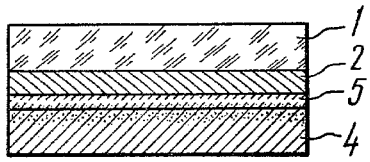
FIG. 4 is a cross-sectional view, in elevation, showing a material sensitive to an electromagnetic and corpuscular irradiation with a protective layer.

Shown in FIG. 4 is a sectional view of a material sensitive to electromagnetic and corpuscular irradiation provided with a protective antidiffusion layer 5 after annealing is conducted to a complete dissolution of the barrier layer. The protective layer 5 makes it possible to perform a directional dissolution of the barrier layer 3 only in the metal layer 4 without any partial dissolution of the barrier layer 3 in the semiconductor layer 2 thus retaining an unchanged band of the spectral sensitivity of the material.

The material for the protective antidiffusion layer 5 can be made of oxides of the metals employed for the barrier layer 3, oxides of silicon or germanium, organic polymer films of polyacrylate, polymethylsiloxane and the like, i.e. materials inert in respect of the layer 2 of the semiconductor upon heating to the annealing temperature. The thickness of the protective layer 5 is selected to be sufficient to prevent diffusion of the metal of the barrier layer 3 into the layer of the semiconductor 2 during annealing. The protective layer thickness is selected within the range of from 50 to 200 Å.

The presence of the protective layer 5 makes it possible to make the barrier layer 3 thinner (by 25 to 50%) thus facilitating the removal of this layer 3 during annealing. The protective layer 5, which acts as an antidiffusion barrier during annealing, also hinders diffusion of the metal of the layer 4 therethrough and under the action of an actinic irradiation after the removal of the barrier layer 3. However, the layer 5 is readily destroyed under the effect of short ($10^{-3}$–$10^{-8}$ sec) pulses of a laser irradiation providing, at the surface of a material sensitive to the irradiation, a power density of at least $10^3$ Wt/cm$^2$. Such combination of the protective layer 5 and the barrier layer 3 makes it possible to produce a material sensitive to an irradiation and possessing a required range of a spectral sensitivity and a high sensitivity to a radiation with a power density sufficient for the deterioration of the protective layer 5.

For a better understanding of the present invention some specific examples are given hereinbelow for illustration of the process for producing materials sensitive to an electromagnetic and corpuscular radiation.

EXAMPLE 1

Onto a glass substrate 1 (FIG. 1) made of a flame-polished glass with a thickness of 3 mm there are successively deposited in vacuum ($1.10^{-5}$ mm Hg) by methods of thermal evaporation a layer 2 of a semiconductive alloy $AsS_{1.5}Se_{0.5}$ with the thickness of 300 Å, a barrier layer 3 made of gold with the thickness of 40 Å and a layer 4 of a metal, i.e. silver, with the thickness of 4,000 Å. The thus-manufactured material is coated with a varnish coating and then subjected to thermal annealing in vacuum ($1.10^{-5}$ mm Hg) for 3 hours at the temperature of 80° C. until complete dissolution of the barrier layer 3. Sensitivity of the material after annealing is increased by 20 times upon exposure to radiation corresponding to a range of the proper absorption of the substance of the semiconductor layer. Further annealing at this temperature results in no increase in the material sensitivity to the actinic radiation.

Evaporation of a layer 4 of silver, under the same conditions, directly onto the layer 2 of the semiconductor $AsS_{1.5}Se_{0.5}$ has resulted in their chemical interaction during the vacuum evaporation of the metal layer 4 thus making it impossible to obtain a material sensitive to an actinic radiation.

EXAMPLE 2

Onto a glass substrate 1 (FIG. 1) of a hot-polished glass with the thickness of 3 mm there are successively applied in vacuum ($1.10^{-5}$ mm Hg), using the thermal evaporation method, a layer 2 of a semiconducting alloy $SbS_{1.5}Se_{0.5}$ having a thickness of 300 Å, a barrier layer 3 of gold having a thickness of 40 Å. The metal layer 4 is deposited by electron-ray scattering; the silver layer thickness is 4.000 Å. The thus manufactured material is coated with a varnish coating and subjected to thermal annealing in vacuum ($1.10^{-5}$ mm Hg) for 3 hours at a temperature of 80° C. to a complete dissolution of the barrier layer to obtain a maximal sensitivity of the material. The material sensitivity after annealing is increased by 20 times.

Evaporation of a metal layer 4 of silver under the same conditions directly onto the layer 2 of the semiconductor $SbS_{1.5}Se_{0.5}$ has resulted in their chemical interaction during vacuum evaporation of the metal layer 4 and impossibility of production of a material sensitive to an electromagnetic and corpuscular radiation.

EXAMPLE 3

A material sensitive to an electromagnetic and corpuscular radiation with layers 2, 3 and 4 deposited as described in Example 1 is subjected to annealing under the conditions of the foregoing Examples 1 and 2, except that the annealing duration is reduced by 30%. Such reduction in the annealing duration has resulted in a partial dissolution of the barrier layer 3 (FIG. 2) and caused reduction in the sensitivity by 2 times as compared to the material for which a complete dissolution of the barrier layer 3 had been performed.

The material with a partially removed barrier layer 3 is characterized with a more linear exposure characteristic (the initial region of the exposure characteristic is "straightened") as compared to the material which has been annealed to a complete dissolution of the barrier layer. Deposition of a barrier layer 3 of a smaller thickness (20 Å) for the production of a material with the same sensitivity as after partial annealing has resulted in a partial chemical reaction between the semiconductive layer 2 and the metal layer 4 during the evaporation of the latter thus causing a reduction in the initial coefficient of reflection of the material (by 50%). Reading information recorded on such a material sensitive to an electromagnetic and corpuscular radiation is effected at a smaller ratio "signal/interference", i.e. reliability of the information read-out is lowered.

EXAMPLE 4

Onto a polished glass substrate 1 (FIG. 1) in vacuum ($1.10^{-5}$ mm Hg) using the method of thermal evaporation there are successively deposited a layer 2 of a semiconductive substance $As_2S_5$ with a thickness of 300 Å, a barrier layer 3 of chromium with a thickness of 30 Å and a metal layer 4 of silver with a thickness of 3,000 Å. The thus-manufactured material is coated with a silicone varnish and subjected to thermal annealing in the atmosphere of an inert gas (argon) under a pressure of $1.10^{-2}$ mm Hg at a temperature of 120° C. and constituting 0.9 of the temperature of vitrification of the semiconductive layer for 4 hours to a complete dissolution of the barrier layer. Annealing at this temperature has resulted, upon increasing the material sensitivity, after annealing, to a radiation with a wave length of 488 mm by 25 times, in that the material sensitivity outside the range of the proper absorption of the seniconductive layer 2 to a radiation with the wave length of 632.8 mm increased only by 4 times. Lowered sensitivity of the material outside the range of its proper absorption contributes to an increased reliability of the information storage. Production of a material sensitive to electromagnetic and corpuscular irradiation with a semiconductive layer 2 and a metal layer 4 has resulted in a partial interaction between the semiconductive layer 2 and metal layer 4 upon deposition of the latter metal layer 4. The partial chemical interaction of the layers 2 and 4 upon deposition of the layer 4 has resulted in decrease of the reflection coefficient of the material prior to the irradiation by 2 times. Stabilizing annealing of the material to lower the sensitivity to radiation with wave lengths outside the range of proper absorption without the barrier layer 3 has appeared to be impossible for the given layers 2 and 4.

EXAMPLE 5

Onto a quartz polished substrate 1 (FIG. 1) with the thickness of 5 mm there are successively deposited, in vacuum ($1.10^{-5}$ mm Hg) using the method of thermal evaporation, a layer 2 of a semiconductive compound $As_2S_3$ with a thickness of 300 Å, a barrier layer 3 of an alloy Mo-Au (deposited by the method of electron-ray evaporation) with a thickness of 40 Å, and a metal layer 4 of silver (deposited by thermal evaporation) with a thickness of 4,000 Å. The thus-manufactured material is coated with a silicone varnish applied onto a surface of the metal layer 4 by centrifugation, after which annealing is performed in vacuum of $1.10^{-5}$ mm Hg for a period of 3 hours at a temperature of 100° C. until complete dissolution of the barrier layer 3. The material sensitivity after annealing has been increased by 30 times upon exposure to radiation corresponding to the range of the proper absorption of the semiconductive layer 2 (wave length=488.0 mm). Since condensation of the silver layer 2 occurs at the surface of the barrier layer 3 having a fine-crystal structure (with a crystal size of at most 20–30 Å), the silver layer structure is also fine-crystalline. Direct deposition of the silver layer 4 onto the vitreous layer 2 of the semiconductor $As_2S_3$ results in condensation of silver in the form of a large-crystal structure with a crystal size comparable with the thickness of the layer 4, and therefore in a reduction of the resolving power.

EXAMPLE 6

Onto a hot-polished glass substrate 1 (FIG. 4) with a thickness of 3 mm there are successively deposited in vacuum ($1.10^{-5}$ mm Hg) by a method of thermal evaporation a layer 2 of a semiconductive alloy $AsS_{1.5}Se_{0.5}$ with a thickness of 400 Å, a protective layer 5 with a thickness of 60 Å of germanium monoxide; a barrier layer 3 of gold with a thickness of 20 Å, and a metal layer 4 of silver with a thickness of 4,000 Å. The thus-manufactured material is coated with a varnish coating and subjected to thermal annealing in an atmosphere of argon ($1.10^{-2}$ mm Hg) for 2.5 hours at a temperature of 80° C. to a complete dissolution of the barrier layer 3 in the metal layer 4.

The protective layer 5 hinders dissolution of the barrier layer 3 in the semiconductor layer 2 thus retaining the unchanged range of the spectral sensitivity of the material. After the annealing operation the protective layer 5 is retained in the material structure but it is readily broken under the effect of radiation pulses with the duration of $10^{-5}$ sec ensuring power density of at least $10^3$ Wt/cm$^2$ at the carrier surface. The material has a very low sensitivity to a radiation of smaller intensity (by 100–200 times lower than the sensitivity to the radiation with the power density of at least $10^3$ Wt/cm$^2$).

EXAMPLE 7

Onto a glass substrate 1 (FIG. 1) of a hot-polished glass with a thickness of 3 mm there are deposited in vacuum ($1.10^{-5}$ mm Hg) using the method of thermal evaporation successively a layer 2 of a semiconductive alloy AsSSe with a thickness of 400 Å, a barrier layer 3 of arsenic with a thickness of 200 Å and a metal layer 4 of silver with a thickness of 4,000 Å. The thus manufactured material is coated with a silicone varnish. The material has been stored for 6 months without any darkening from a background radiation with a power density of $0.5\times10^{-3}$ Wt/cm$^2$ (this exposure corresponds to a illumination of $10^3$ lx at an open place in the day time without sun) without any changes in the reflection coefficient. Directly prior to recording information on the material, it is annealed for 4 hours at a temperature of 110° C. until a complete dissolution of the barrier layer 3. As a result, after the annealing step a sensitivity of the material is obtained which enables it to record pulses of electromagnetic radiation with a power density of $0.5\times10^{-3}$ Wt/cm$^3$ and duration of 100 seconds.

EXAMPLE 8

Onto a glass substrate 1 (FIG. 1) of a hot-polished glass with a thickness of 3 mm there are successively deposited by thermal evaporation in vacuum ($1.10^{-5}$ mm Hg) a layer 2 of arsenic sulphide $As_2S_3$ with a thickness of 300 Å, a barrier layer 3 of the alloy Cr-Au with a thickness of 40 Å and a metal layer 4 of silver with the thickness of 4,000 Å. The rate of evaporation of the silver layer 4 is selected to optimally obtain a fine crystal structure of the layer 4 at the surface of the barrier layer 3 (about 100 Å/sec).

The material is coated with a silicone varnish and subjected to annealing in the atmosphere of an inert gas (argon) under a pressure of $10^{-2}$ mm Hg for 3 hours at a temperature of 100° C.

After annealing, the material sensitivity to irradiation with a wave length of 488.0 mm is increased by 30 times. Direct evaporation of the metal (silver) layer 4 onto the layer 2 of $As_2S_3$ is possible only at a very high rate of deposition (a film with the thickness of 4,000 Å is deposited over 5 sec.). However, the metal film condensed at this rate has a large crystal structure which results in a reduced resolving power of the material.

What is claimed is:

1. A process of producing a material sensitive to electromagnetic and corpuscular radiation comprising the following steps: depositing, onto a transparent substrate, a layer of a semiconductive material; depositing, unto said layer of the semiconductive material, a barrier layer inert to the layer of the semiconductive material; depositing, unto said barrier layer, a layer of a metal capable of chemically reacting with said semiconductive layer under the effect of said electromagnetic and corpuscular radiation with formation of reaction products having physical and chemical properties different from those of said metal layer and semiconductive layer; annealing of the resulting laminated structure at a temperature at least equal to the temperature of diffusion of the material of said barrier layer into the material of at least one of said layers adjacent thereto, said annealing step being conducted for a period of time sufficient for at least partial dissolution of said barrier layer and prior to the exposure of the material to radiation.

2. A process as claimed in claim 1, wherein said annealing step is conducted to a complete dissolution of said barrier layer.

3. A process as claimed in claim 1, wherein prior to the step of depositing said barrier layer onto said semiconductive layer, there is carried out the further step of applying a protective layer which performs the function of an antidiffusion barrier between said barrier and semiconductive layers.

4. A process as claimed in claim 1, wherein said semiconductive layer is made of a substance selected from the group consisting of As-S, As-Se, Sb-S, Sb-Se, As-S-Se, Sb-S-Se; and said annealing step is conducted at a temperature equal to 0.7–0.9 of the vitrification temperature of the substance of said semiconductive layer.

* * * * *